US005755629A

United States Patent [19]

Blomgren

[11] Patent Number: 5,755,629

[45] Date of Patent: May 26, 1998

[54] GOLF ACCESSORY

[76] Inventor: Hans Blomgren, Rostvägen 8, Vänersborg, Sweden, S-462 30

[21] Appl. No.: 682,538

[22] PCT Filed: Jan. 24, 1995

[86] PCT No.: PCT/SE95/00057

§ 371 Date: Jul. 25, 1996

§ 102(e) Date: Jul. 25, 1996

[87] PCT Pub. No.: WO95/19818

PCT Pub. Date: Jul. 27, 1995

[30] Foreign Application Priority Data

Jan. 25, 1994 [SE] Sweden ..... 9400199

[51] Int. Cl.[6] ..... A63B 57/00

[52] U.S. Cl. ..... 473/408; 473/397

[58] Field of Search ..... 473/408, 387–403, 473/286, 284, 285

[56] References Cited

U.S. PATENT DOCUMENTS

| | | | |
|---|---|---|---|
| 1,717,962 | 6/1929 | Deike | 473/392 |
| 3,406,978 | 10/1968 | Johnson, Jr. | 473/397 |
| 3,620,426 | 11/1971 | Hatch | 473/408 |
| 3,966,214 | 6/1976 | Collins | 473/397 |
| 4,114,878 | 9/1978 | Hammond | 473/408 |
| 4,960,239 | 10/1990 | Wait | 473/408 |
| 5,054,777 | 10/1991 | Borden et al. | 473/408 |
| 5,211,395 | 5/1993 | Liao | 473/408 |
| 5,226,647 | 7/1993 | Notarmuzi . | |

FOREIGN PATENT DOCUMENTS 2222090 2/1990 United Kingdom .

*Primary Examiner*—Steven B. Wong

*Attorney, Agent, or Firm*—Samuels, Gauthier, Stevens & Reppert

[57] ABSTRACT

A golf accessory (10) is disclosed in the form of an elongate pitch mark repairer (12) extending along a longitudinal axis (14). The pitch mark repairer has a pair of spaced-apart prongs (16) extending from a body portion (18). The body portion (18) presents a transversely extending axis (20) about which a tee (22) is pivotally disposed.

9 Claims, 4 Drawing Sheets

GOLF ACCESSORY

TECHNICAL FIELD

The present invention relates to a golf accessory in the form of an elongate pitch mark repairer extending along a longitudinal axis, the pitch mark repairer comprising a pair of spaced-apart prongs extending from a body portion.

BACKGROUND OF THE INVENTION

Pitch mark repairers of the above-mentioned type form an essential part of a golfer's equipment. Pitch mark repairers are used to repair the indentation or pitch mark which a golf ball makes when it lands on the green surrounding the hole. Many golf courses and national golf associations insist that each player possesses a pitch mark repairer before starting play and players are randomly monitored to ensure that they are repairing their pitch marks adequately.

The pitch mark repairer is just one of many accessories which a golfer needs at his disposal when playing a round of golf. A typical golfer's pocket may contain the requisite pitch mark repairer, a selection of tees of varying length and a ball marker for marking the position of the golf ball on the green. As well as damaging the pocket lining due to the plurality of pointed ends which the above list of articles possess, the sheer number of articles in the golfer's pocket means that time is lost fumbling in the pocket when attempting to retrieve the desired article.

In terms of golf tees, depending on the club with which the player is intending to hit the golf ball, the height above the ground at which the ball is supported on the tee is often perceived as being of paramount importance, hence the need for a plurality of tees of differing lengths. Clearly, the height of the ball above the ground depends on how far into the ground the tee is inserted. Many golfers repeatedly adjust this height in an attempt to obtain the correct height which feels "best" for the club which they are about to swing. Such action obviously wastes time. Once the ball has been struck, the tee often shears or is knocked out of the ground. Many golfers are unable or simply cannot be bothered to find the thus ejected tee and the tee is left lying on the course where it presents a hazard to the blades of the equipment used for grass-cutting.

A partial solution to the problem of lost golf tees is described in SE-B-463 015 in which a body is provided into which the prongs of a pitch mark repair tool are retractable. The body further comprises a pair of compartments for two golf tees, with the tees being attached to the body by means of a flexible cord. Such an accessory does however require that the golfer removes a tee from the body on order to tee up the ball and then replaces the tee in the body after having struck the ball.

SUMMARY OF THE INVENTION

It is therefore an object of the invention to provide a golf accessory which not only reduces the number of articles which a golfer needs to carry on him, but also speeds up play and reduces the risk of damage to grass-cutting equipment.

Accordingly, the present invention provides a golf accessory in the form of an elongate pitch mark repairer extending along a longitudinal axis, the pitch mark repairer comprising a pair of space-apart prongs extending from a body portion, wherein the body portion further includes a transversely extending axis about which a tee is pivotally disposed.

Because a tee is incorporated in the pitch mark repairer, the number of articles which a golfer needs is reduced.

Since the tee is pivotally disposed on the body portion of the pitch mark repairer, it does not need to be removed prior to use. In addition, there is less likelihood of the accessory according to the invention being knocked out of the ground. Even if it were knocked out, because of its size it is easier to locate.

BRIEF DESCRIPTION OF THE DRAWINGS

The invention will be described in the following in more detail and with reference to the attached drawings, in which.

DETAILED DESCRIPTION OF THE INVENTION

Figure 1:
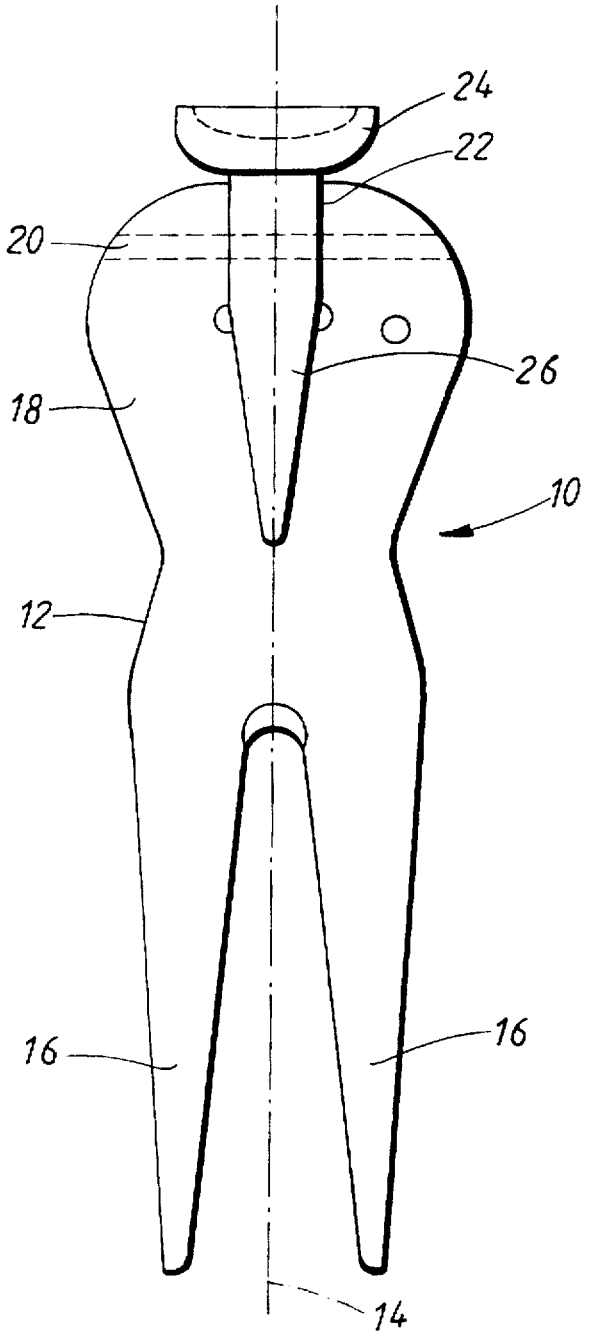
FIG. 1 is an elevational view of the golf accessory according to the invention in a first position.

In FIGS. 1 to 5, reference numeral 10 generally denotes a first embodiment of the golf accessory according to the present invention. The golf accessory 10 is in the form of an elongate pitch mark repairer 12 which extends along a longitudinal axis 14. As is normal in the art, the pitch mark repairer comprises a pair of spaced-apart prongs 16 extending from a body portion 18. In accordance with the present invention, the body portion 18 presents a transversely extending axis 20 about which a tee 22 is pivotally disposed.

As is apparent from FIG. 1, the pitch mark repairer 12 is preferably substantially symmetrical about its longitudinal axis 14, with the tee 22 being disposed symmetrically along the longitudinal axis.

The tee 22 comprises a head portion 24 presenting an upwardly directed concave surface adapted to support a golf ball and an shaft portion 26 extending from the head portion 24. The shaft portion 26 is pivotally carried by the body portion 18 of the pitch mark repairer for displacement of the tee 22 between a first position as shown in FIGS. 1 and 2 in which the shaft portion 26 extends along the longitudinal axis 14 of the pitch mark repairer and a second position shown in FIG. 3 in which the tee 22 forms substantially a right angle to the longitudinal axis 14.

Figure 2:
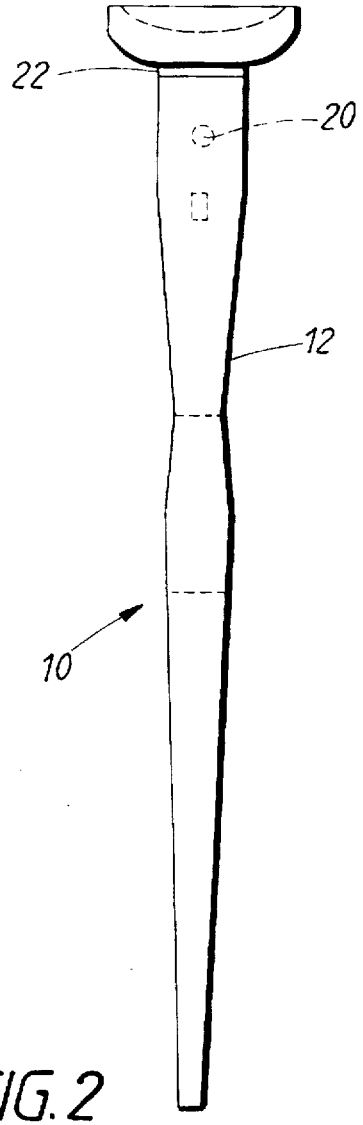
FIG. 2 is a side elevational view of the golf accessory shown in FIG. 1.

As is best illustrated in FIG. 2, when the tee 22 is in its first position, the shaft portion 26 is substantially accommodated within the body portion 18 of the pitch mark repairer 12.

Figure 3:
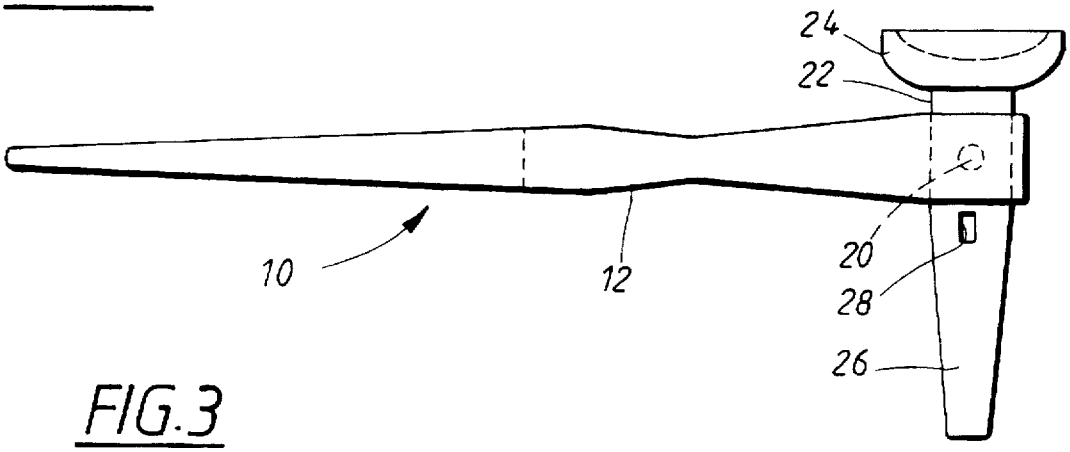
FIG. 3 is a side elevational view of the golf accessory according to the invention in a second position.

With reference to FIG. 3, when the tee 22 is in its second position, a length of the shaft portion 26 remote from the head portion 24 of the tee projects from the pitch mark repairer 12. As will be explained later, this portion of the tee is adapted to be pushed into the ground to enable a golf ball to be teed up on the tee 22.

Figure 4:
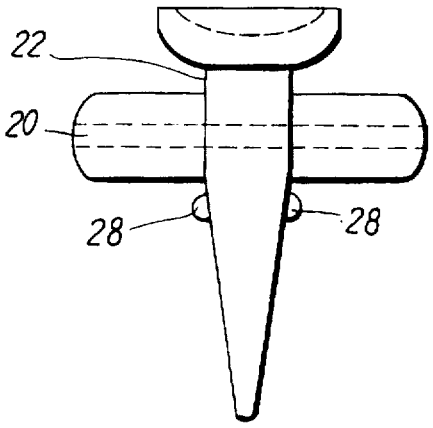
FIG. 4 is an end view of the golf accessory shown in FIG. 4.

As is apparent from FIGS. 3 and 4, the length of the shaft portion 26 of the tee 22 which is adapted to be pushed into the ground is tapered to aid insertion of the tee into the ground. This length of the shaft portion is also provided with a pair of nodules 28 on opposed transverse sides of the tee. These nodules 28 assist in frictionally maintaining the tee 22 in its first position as illustrated in FIGS. 1 and 2.

Figure 5:
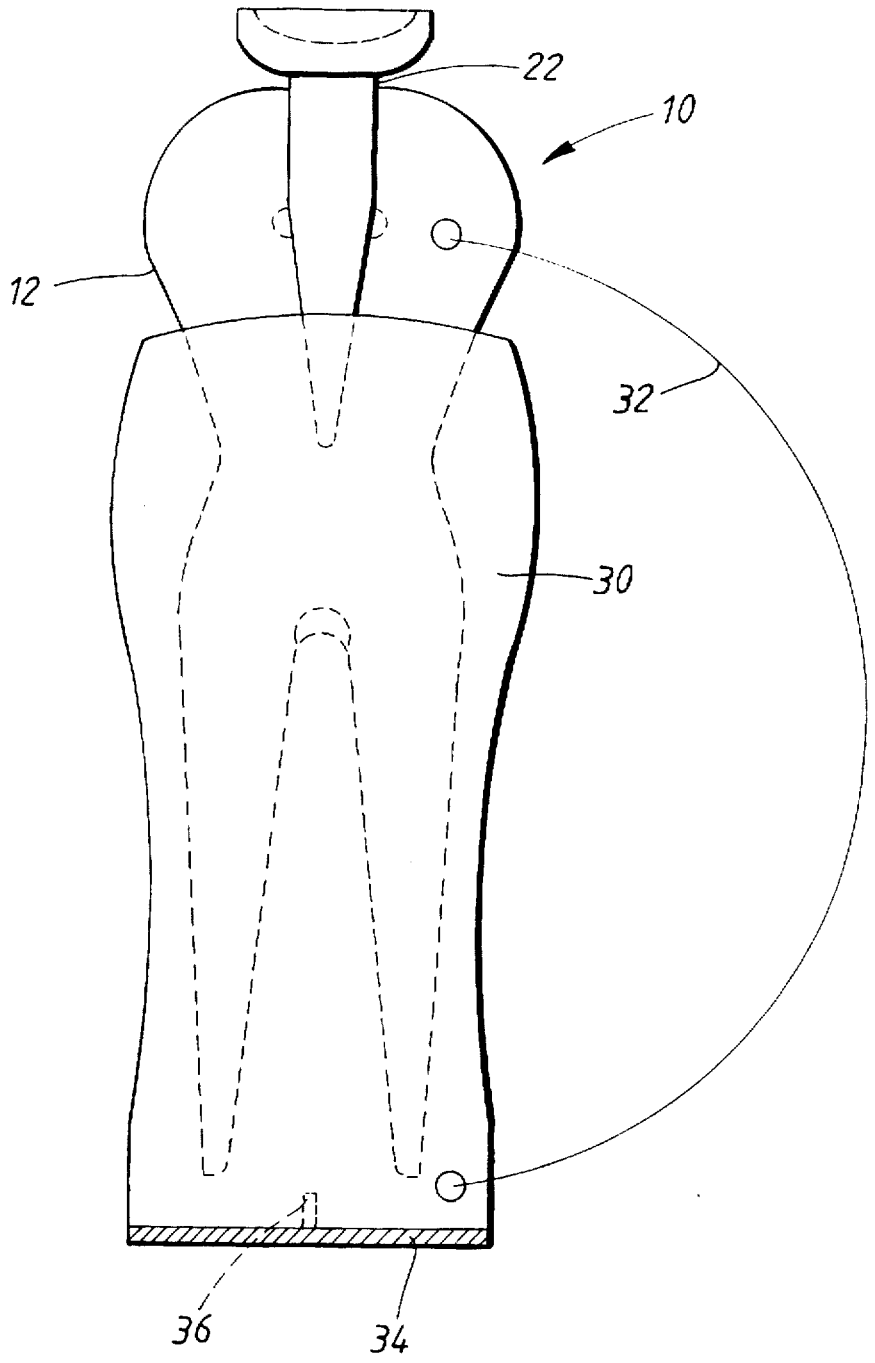
FIG. 5 is an elevational view of the golf accessory according to the invention inserted in a carrying sleeve.

In order to protect a player's trouser pocket from wear and tear, it is advantageous if the golf accessory 10 according to the invention be housed in a sleeve 30, as illustrated in FIG. 5. To further reduce the chances of losing the pitch mark repairer, the sleeve 30 is preferably connected to the pitch mark repairer 12 via a flexible cord 32. The sleeve also provides a suitable attachment for a ball marker 34. The ball marker is in the form of a flat disc with a protruding pin 36 which is accommodated within a corresponding recess in the base of the sleeve 30 to releasably attach the ball marker to the sleeve.

The first embodiment of the golf accessory in accordance with the present invention may be used in the following manner. Firstly, the accessory is removed from the sleeve 30. If the accessory is to be used to repair a pitch mark, then it is used in the same manner as a conventional pitch mark repairer. If the accessory is to be used as a tee to tee up a golf ball, the accessory can be used in either of two ways. Firstly, should the player require a relatively high tee, he inserts the prongs 16 of the pitch mark repairer 12 into the ground to a predetermined level, for example corresponding to the pointed end of the tee 22. The golf ball is then placed on the head portion 24 of the tee and the player may then attempt to hit the ball. After having made his stroke, the player may have uprooted the accessory from the ground. In such a case, because the accessory is more visible than a conventional tee, it is much easier to locate. This is particularly true when the accessory is connected to the sleeve 30 via the cord 32.

Should the player require a relatively low tee, he pivots the tee 22 about the transverse axis 20 until the tee adopts its second position as illustrated in FIGS. 3 and 4. The tapered shaft portion 26 of the tee is then inserted into the ground. The golf ball is then placed on the head portion 24 of the tee and the player may then attempt to hit the ball. Similarly, if the tee becomes uprooted during the stroke, it is relatively easy to locate.

Figure 6:
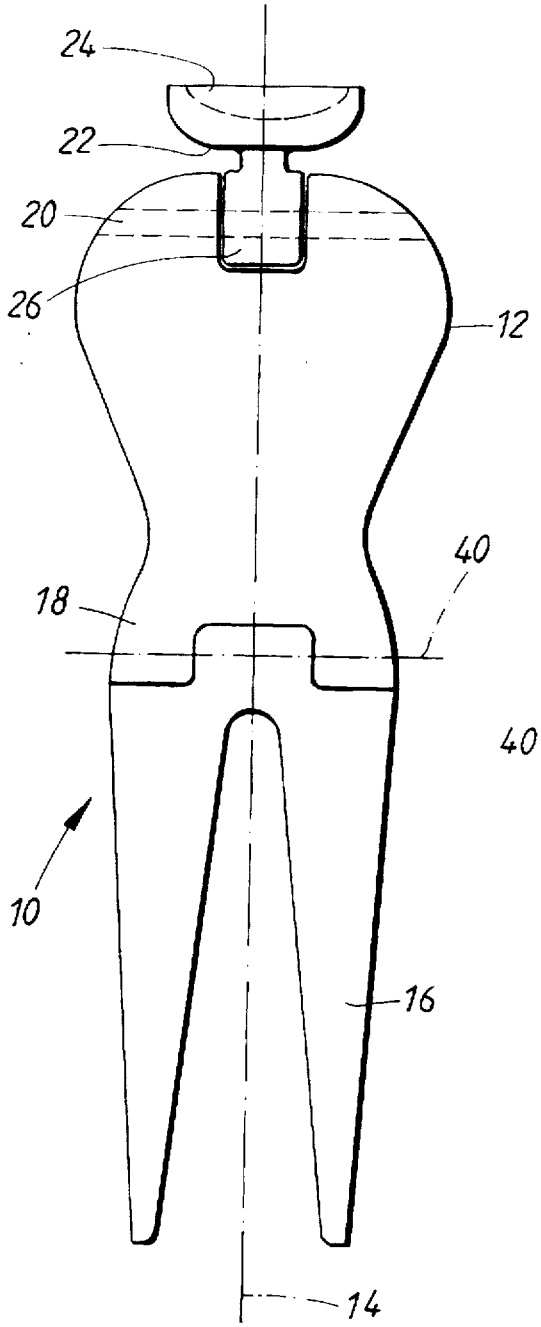
FIG. 6 is an elevational view of the golf accessory according to a second embodiment of the invention in a first position.
Figure 7:
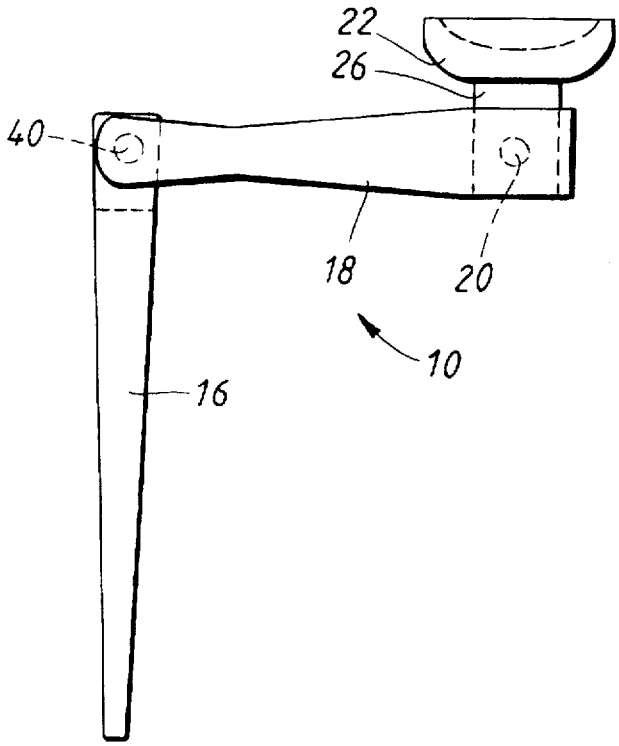
FIG. 7 is a side elevational view of the golf accessory according to FIG. 6 in a second position.

A second embodiment of the golf accessory in accordance with the present invention is illustrated in FIGS. 6 and 7. Where features of the second embodiment correspond to like features of the first embodiment, the same reference numerals have been used. Accordingly, the golf accessory 10 is in the form of an elongate pitch mark repairer 12 which extends along a longitudinal axis 14. The pitch mark repairer comprises a pair of spaced-apart prongs 16 and a body portion 18. In the second embodiment, however, the pair of prongs 16 are pivotally attached to the body portion 18 about a transversely extending axis 40 for displacement between a first position as illustrated in FIG. 6 and a second position as illustrated in FIG. 7.

In accordance with the present invention, the body portion 18 presents a transversely extending axis 20 about which a tee 22 having a head portion 24 and a shaft portion 26 is pivotally disposed between a first position as shown in FIG. 6 in which the shaft portion 26 extends along the longitudinal axis 14 of the pitch mark repairer and a second position shown in FIG. 7 in which the tee 22 forms substantially a right angle to the longitudinal axis 14.

In the second embodiment, the shaft portion 26 of the tee 22 terminates in the vicinity of the transversely extending axis 20 such that when the tee 22 is in its second position, substantially no part of the shaft portion remote from the head portion 24 of the tee projects from the pitch mark repairer. The pivotal connection between the tee 22 and the pitch mark repairer 12 is designed so that the tee can maintain its second position even when supporting the weight of a golf ball.

Accordingly, the tee 22 of the present invention can be releasably locked in either or both of a first position in which the shaft portion 26 extends along the longitudinal axis 14 of the pitch mark repairer 12 and a second position in which the tee forms substantially a right angle to the longitudinal axis.

Obviously, the golf accessory according to the second embodiment may also be provided with a sleeve similar to that provided for the first embodiment.

The second embodiment of the golf accessory in accordance with the present invention may be used in the following manner. Firstly, the accessory is removed from its sleeve. If the accessory is to be used to repair a pitch mark, then it is used in the same manner as a conventional pitch mark repairer. If the accessory is to be used as a tee to tee up a golf ball, the accessory can be used in either of two ways. Firstly, should the player require a relatively high tee, he inserts the prongs 16 of the pitch mark repairer 12 into the ground to a predetermined level, for example corresponding to the transverse axis 40 . The golf ball is then placed on the head portion 24 of the tee and the player may then attempt to hit the ball. After having made his stroke, the player may have made contact with the pitch mark repairer. Rather than uprooting the pitch mark repairer, it is most probable that the body portion 18 of the pitch mark repairer 12 will pivot about the transverse axis 40 whilst the prongs 16 remain in the ground. Thus, it is unlikely that the pitch mark repairer will be lost. Should, however, the force of the blow be so great that the pitch mark repairer does become uprooted, because the accessory is more visible than a conventional tee, it is much easier to locate. This is particularly true when the accessory is connected to the sleeve 30 via the cord 32.

Should the player require a relatively low tee, he pivots the tee 22 about the transverse axis 20 until the tee adopts its second position as illustrated in FIG. 7. The pair of prongs 16 are inserted into the ground substantially up to the transverse axis 40 connecting the prongs to the body portion 18. The body portion 18 is then pivoted about the transverse axis 40 to assume the position illustrated in FIG. 7. The golf ball is then placed on the head portion 24 of the tee and the player may then attempt to hit the ball. Assuming that the player strikes the ball, it is most unlikely that the golf accessory be uprooted. Instead, since the tee 22 is pivotally attached to the body portion 18 of the pitch mark repairer 12, it is probable that the tee 22 will merely pivot about the transverse axis 20. Should the tee becomes uprooted during the stroke, however, it is still relatively easy to locate.

Should the player require the golf ball to be teed at a height somewhere between the two positions described above, it is possible to achieve this by inclining the body portion 18 of the pitch mark repairer at an angle, say 135°, to the prongs 16 and inclining the tee 22 at a corresponding angle to the body portion 18. Naturally, this requires that a frictional hinge of known type be employed on the respective transverse axes 20 and 40. In this manner, an infinite number of differing tee heights can be obtained.

The invention is naturally not restricted to the embodiments described above and shown in the drawings, but may be varied within the scope of the appended claims.

I claim:

1. A golf accessory comprising:

an elongate pitch mark repairer extending along a longitudinal axis, said pitch mark repairer comprising:

a body portion having an axis extending transversely therethrough, and a pair of spaced-apart prongs extending from said body portion: and a tee disposed symmetrically along said longitudinal axis, said tee comprising:

a head portion adapted to support a golf ball, and a shaft portion extending from said head portion, said shaft portion being pivotally disposed about said transversely extending axis of said pitch mark repairer for displacement of the tee between a first position in which the shaft portion extends along the longitudinal axis of the pitch mark repairer and a second position, in which the tee forms substantially a right angle to said longitudinal axis, wherein when said tee is in said second position, a length of said shaft portion remote from the head portion of the tee projects from the pitch mark repairer, which length is adapted to be insertable into the ground.

2. The golf accessory as claimed in claim 1, wherein said length of said shaft portion is tapered to aid insertion of the tee into the ground.

3. The golf accessory as claimed in claim 1, wherein when said tee is in said first position, said shaft portion is substantially accommodated within the body portion of the pitch mark repairer.

4. A golf accessory comprising:

an elongate pitch mark repairer extending along a longitudinal axis, said pitch mark repairer comprising:

a body portion having an axis extending transversely therethrough, and a pair of spaced-apart prongs pivotally connected to said body portion of the pitch mark repairer for displacement between a first position in which the pair of prongs lies along the longitudinal axis of the pitch mark repairer and a second position; and a tee disposed symmetrically along said longitudinal axis, said tee comprising:

a head portion, and a shaft portion extending from said head portion, said shaft portion being pivotally disposed about said transversely extending axis of said pitch mark repairer for displacement of the tee between a first position in which the shaft portion extends along the longitudinal axis of the pitch mark repairer and a second position in which the tee forms substantially a right angle to said longitudinal axis, wherein said head portion is adapted to support a golf ball in said first and second positions of said tee, and when said pair of spaced-apart prongs is in said second position, said pair of spaced-apart prongs extends in a direction substantially opposite to that of the tee when the tee is in its second position.

5. The golf accessory as claimed in claim 4, wherein means are provided for maintaining the prongs at an intermediate position between said first and second positions.

6. The golf accessory as claimed in claim 4, wherein means are provided for maintaining the tee at an intermediate position between said first and second positions of the tee.

7. The golf accessory as claimed in claim 4, wherein means are provided for releasably locking the tee in either or both of its first and second positions.

8. The golf accessory as claimed in claims 1 or 4, wherein the accessory further comprises a sleeve for accommodating at least the spaced-apart prongs of the pitch mark repairer, said sleeve being connected to said pitch mark repairer by means of a flexible cord.

9. The golf accessory as claimed in claim 4, wherein said shaft portion terminates in the vicinity of the transversely extending axis such that when said tee is in said second position, substantially no part of the shaft portion remote from the head portion of the tee projects from the pitch mark repairer.

* * * * *